US005557061A

United States Patent [19]

Ramaswamy

[11] Patent Number: 5,557,061

[45] Date of Patent: Sep. 17, 1996

[54] HIGH TEMPERATURE STABLE, LOW INPUT ENERGY PRIMER/DETONATOR

[75] Inventor: Coodly P. Ramaswamy, Christiana, Pa.

[73] Assignee: Breed Automotive Technology, Inc., Lakeland, Fla.

[21] Appl. No.: 254,484

[22] Filed: Jun. 6, 1994

Related U.S. Application Data

[60] Continuation of Ser. No. 616,578, Nov. 14, 1990, abandoned, which is a division of Ser. No. 326,021, Mar. 20, 1989, abandoned.

[51] Int. Cl.[6] ..... C06B 41/08

[52] U.S. Cl. ..... 149/26; 149/35

[58] Field of Search ..... 149/26, 35

[56] References Cited

U.S. PATENT DOCUMENTS

| | | | |
|---|---|---|---|
| 1,350,465 | 8/1920 | Peck | 149/26 |
| 2,156,942 | 5/1939 | Hatch | 149/26 |
| 2,177,657 | 10/1939 | Kerone et al. | 149/26 |
| 2,341,262 | 2/1944 | Brün et al. | 149/26 |
| 3,293,091 | 12/1966 | Kenney | 149/26 |
| 3,420,137 | 1/1969 | Staba | 149/26 |
| 3,634,155 | 1/1972 | Prior | 149/26 |
| 4,247,494 | 1/1981 | Carter | 149/26 |
| 4,336,084 | 6/1982 | Urs | 149/24 |
| 4,640,724 | 2/1987 | Carter et al. | 149/28 |
| 5,043,030 | 8/1991 | Ramaswamy | 149/28 |
| 5,054,396 | 8/1991 | Grommes et al. | 102/204 |

OTHER PUBLICATIONS

Hawley, *The Condensed Chemical Dictionary*, 9th Ed., p. 166, Van Nostrand Reinhold (1977) New York.

*Primary Examiner*—Edward A. Miller

*Attorney, Agent, or Firm*—Kane, Dalsimer, Sullivan, Kurucz, Levy, Eisele and Richard

[57] ABSTRACT

A method for the manufacture of primers/detonators with 90–99.99% reliability and achieving sensitivity of 0.8 inch-oz to 3.0 inch-oz, able to withstand temperatures within the range of 40° C. to 200° C. and able to withstand temperature cycling and humidity for 95% RH at 95° C. to –40° C. Mechanical and chemical sensitizers are utilized in lieu of tetracene, the utilization of oxidizers as sensitizers, the utilization of high energy fuels, and a method of co-precipitating the primary explosive and mechanical sensitizer.

1 Claim, No Drawings

HIGH TEMPERATURE STABLE, LOW INPUT ENERGY PRIMER/DETONATOR

This application is a continuation of application Ser. No. 07/616,578 filed Nov. 14, 1990, now abandoned, which is a divisional of application(s) Ser. No. 07/326,021 filed on Mar. 20, 1989, now abandoned.

BACKGROUND OF THE INVENTION

The invention relates to a method of manufacturing primers/detonators stable at high temperatures up to 100° C. or better, having an all-fire impact sensitivity of 1.0 inch-oz or less, and high degree of reliability.

The invention more particularly relates to the development of a primer/detonator, which can function with a very high degree of reliability at temperatures as low as −40° C., as high as 100° C. or better, and function equally well at ambient temperatures, and should have an all-fire sensitivity to impact of 1 inch-oz or less in the aforementioned temperature range.

The explosive industry uses a variety of primers/detonators. Basically these devices consist of a primary explosive component initiated by stab (friction) or impact, an intermediate explosive composition to be set-off by the primer composition, and a base charge of secondary explosive like RDX or HMX to give the desired output to perform work, which may be to set off another explosive device in the ignition train. One of the common low input energy primers/detonators is an M55 Detonator, which is extensively used in ordnance for anti-personnel and anti-vehicular munition systems. The make up of these detonators consist of:

(a) A primary explosive composition containing basic lead styphnate, dextrinated lead azide, antimony sulfide, barium nitrate, and tetracene.

(b) An intermediate explosive charge of RD 1333 lead azide.

(c) RDX as secondary explosive.

These detonators/primers are set-off by stab action with a firing pin and show a sensitivity of about 0.80 inch-oz at 99.99% reliability and 95% confidence level. In this detonator system, while basic lead styphnate and dextrinated lead azide fill their role as the main primary explosives, barium nitrate fills the role as a supplier of oxygen to the system and the antimony sulfide as a fuel cum mechanical sensitizer, because of its high melting point. But it is tetracene that plays a unique and important role. It is a chemical sensitizer with the unique property that makes the system function at an input sensitivity or energy below 1 inch-oz.

While tetracene is an excellent sensitizer and one of the best which explosive chemists have developed, its inherent weakness is that when temperatures higher than 85° C. are encountered, the primers begin to fail. With heat aging above 85° C., the tetracene begins to decompose and leak out from the primer. Sensitivity starts to decrease at 95° C., after 100 hours, the impact energy required will be increased by at least a factor of 3.

While there are many applications for primers/detonators that would function reliably at temperatures of 100° C. or higher (like high cycle firing machine guns), a civilian application is in the automobile crash air bags used in motor vehicles for protecting occupants in crashes. In self-contained air bag modules involving mechanical sensors, the primers are used to ignite the propellant system, which then generates the gas to inflate the air bag. The industry standards demand that air bag systems function reliably at as high a temperature as 100° C.; and at the same time function equally reliably at −40° C. Also, industry standards demand that they function with a high degree of reliability and have a long shelf life.

The operating parameters expected for primers/detonators to fulfill the aforesaid, as well as similar requirements can be summed up as follows:

(i) The composition used in the primer should be easy to manufacture and capable of loading in automatic industry machines used for manufacture of primers/detonators.

(ii) They should be safe for handling, particularly in systems using lead styphnate, where protection against static electricity may be an important safety factor.

(iii) They should be thoroughly stable at temperatures as high as 100° C. and should function reliably at temperatures as low as −40° C.

(iv) In systems using stab action energy to set off the system, the all-fire energy required for setting off the system should be 1 inch-oz or less, similar to those required for primers using tetracene as the sensitizer, where the all-fire sensitivity value is calculated statistically to 99.99% reliability and 95% confidence level for the entire population.

SUMMARY OF THE INVENTION

A principal object of the present invention is to provide conditions of assembly and, make up of detonators for the production of primers/detonators, with a high sensitivity to stab action and a high degree of reliability.

Another object is to eliminate tetracene with its inherent limitation of decomposing at temperatures higher than 85° C. and provide a method to use mechanical sensitizers like sand, glass powder, silicon carbide or fused alumina in primer mixes to improve both sensitivity to impact and temperature aging.

A further object is to provide a method of the foregoing type with a method to co-precipitate the mechanical sensitizer with an explosive to improve homogeneity and sensitivity.

Still another object is to provide a composition using a powerful oxidizer like potassium chlorate as a sensitizer.

Still another object is to provide a composition, eliminating primary explosives like azide and styphnate and using oxidizers and fuels like potassium chlorate and antimony sulfide, in combination with a mechanical and chemical sensitizer, to achieve a high degree of sensitivity, reliability, and temperature aging properties.

Another important object is to improve the primers of the foregoing type to withstand very high temperature by using high energy fuels like selenium and titanium.

Still another important object is to provide a method of manufacturing detonators with a high degree of reliability at 90%–99.99% reliability and 95% confidence level, and achieve primers/detonators of sensitivity 0.8 inch-oz to 3.0 inch-oz, having temperature aging properties that would retain sensitivity from −40° C. to 200° C. and capable of standing temperature cycling and humidity from 95% RH at 95° C. to −40° C.

The above operating parameters could be achieved by eliminating tetracene with its inherent limitation of decomposing at temperatures higher than 85° C., and replacing it with mechanical sensitizers, or by developing an entirely different composition system, using ingredients which are highly stable at the temperatures for which the system is being designed.

Other objectives and advantages of the invention will become more apparent to those skilled in the art, as the invention is disclosed in the examples given below:

DETAILED DESCRIPTION

EXAMPLE 1

| Primer Initiating Composition | | |
|---|---|---|
| Basic Lead Styphnate | 40–42% | use 15-25 milligrams and consolidate at 70–100 Kpsi |
| Lead Azide | 20–22% | |
| Antimony Sulfide | 15–20% | |
| Barium Nitrate | 15–20% | |
| Carborundum | 1–3% | |

Intermediate charges and the base charge could be varied from the standard intermediate lead azide and base charges like PETN, RDX, or HMX to less powerful output charges, like a mixture. of basic lead styphnate, barium nitrate and antimony sulfide or titanium-potassium perchlorate or zirconium-potassium perchlorate.

Detonators assembled as above and initiated by a standard firing pin would stand aging at 100° C. and would give a sensitivity of 2–3 inch-oz at 99% reliability and 95% confidence level.

EXAMPLE II

Similar to Example I, but replacing Carborundum™, supra with ground glass powder or pure silica sand-like ottawa sand and in the same. sieve size spectrum as for Carborundum™, supra in Example I and with output charge as desired. Weight of charge and consolidation pressures also as in Example I, would give primers with a sensitivity of 2–3 inch-oz at 90% reliability and 95% confidence level.

EXAMPLE III

The reliability of mixing mechanical sensitizers like carborundum, sand and glass powder could be very much improved and thus improve the overall reliability by encapsulating the sensitizer into the primary explosive by co-precipitating the primary explosive and the mechanical sensitizer. As an example, the lead styphnate and mechanical sensitizer like Carborundum™ supra, sand, or glass powder could be co-precipitated in the proportion they would be present in the final composition. The method of preparation would be as follows:

A solution of magnesium styphnate is prepared by neutralizing styphnic acid with magnesium oxide, filtering off the excess magnesium oxide. The mechanical sensitzer is suspended in the magnesium styphnate solution in the proportion it exists in the final mixture. Lead nitrate or lead acetate solution is run down into the mixture of magnesium styphnate and mechanical sensitizer, which is kept stirred at 50° C. The co-precipitated lead styphnate mechanical sensitizer is cooked at 50° C. for a further period of 10 minutes, filtered washed thrice with distilled water, and used in making the primer composition.

Primer/detonator made up with the above co-precipitated mix and in a manner similar to that in Example I, improves uniformity and gives a primer with a sensitivity of 3–3.5 inch-oz at 99.99% reliability and a 95% confidence level.

EXAMPLE IV

The mix in Example I could be sensitized by using a more powerful oxidizer in place of tetracene. A typical mix made with the following composition:

Lead Styphnate—40%
Lead Azide—20%
Antimony Sulfide—15%
Barium Nitrate—20%
Potassium Chlorate—5%

The composition in Example IV can be used in place of the primary mix in Example I and primers/detonators made as in Example I, using 25 mgms of the primer composition, consolidated at 100 K.psi gives detonators/primers with a sensitivity of 3.1 inch-oz at 99.99% reliability and 95% confidence level.

EXAMPLE V

A completely new approach is by going away from the conventional primary explosives and still achieve a high degree of sensitivity. This is achieved by using a combination of mechanical and chemical sensitizers. A typical example of such a type is:

Potassium Chlorate—35–37%
Antimony Sulfide—52–56%
Glass Powder—2–3%
Sulfur—3–4%
Lead Thiocyanate—4–6%

The detonator/primer made using the above primary mix, using 15–25 mgms of the mix pressed at 70–100 Kpsi, has an all-fire stab sensitivity of 0.80 inch-oz at 99.99% reliability and 95% confidence level. The base charge could be varied to suit the output desired. Its functionally reliable after aging both at— 40° C. and 100° C. for extended periods, without any significant less in sensitivity.

EXAMPLE VI

The sulfur in Example V can be substituted with high energetic fuels like selenium, titanium, or zirconium. They would maintain the sensitivity and at the same time allow them to be used up to 200° C. without loss in sensitivity.

The scope and ambit of the invention is not limited to the materials, conditions of processing, and assembly of the primer/detonator mentioned. As an example, co-precipitating the lead azide and lead styphate in the proportion it exists in the composition would achieve a higher degree of sensitivity or replace part of the oxidizer in Examples I to III with a more powerful oxidizer like potassium chlorate. Judicious combination of the ingredients could lead to higher sensitivity and higher output. Similarly, newer designs of the firing pin with more acute included angle from 26 used in standard pin up to 14 and also more edges on the pins to develop more hot spots for initiation would make the system function at lesser impact energy.

Thus, the several aforementioned objects and advantages are most effectively attained by the invention which has important application in the ordinance, automobile crash air bag and other fields having need for primers/detonators. Although several embodiments have been disclosed in detail herein, it should be understood that this invention is in no sense limited thereby and its scope is to have determined by that of the appended claims.

I claim:

1. A consolidated mixture of a primer initiating composition omitting tetrazene as a sensitizer yet capable of withstanding aging and providing a relatively high degree of sensitivity, reliability, and confidence level within a wide temperature range consisting essentially of:

from 40 to 42 weight percent of basic lead styphnate;

from 20 to 22 weight percent of lead azide;

from 15 to 20 weight of barium nitrate; and from 1 to 3 weight percent of a sensitizer selected from the group consisting of silicon carbide, fused alumina, ground glass powder, and pure silica sand.

* * * * *

UNITED STATES PATENT AND TRADEMARK OFFICE

CERTIFICATE OF CORRECTION

PATENT NO. : 5,557,061
DATED : Sep. 17, 1996
INVENTOR(S) : Coodly P. Ramaswamy

It is certified that error appears in the above-indentified patent and that said Letters Patent is hereby corrected as shown below:

Column 3, EXAMPLE 1, line 6, "Carborundum" should read -- Carborundum ™ (silicon carbide or fused alumina)--

Column 4, line 35, "less" should read --loss--

Column 5, line 5, after "weight" insert --percent--

Signed and Sealed this
Tenth Day of December, 1996

*Attest:*

*Attesting Officer*

Bruce Lehman

BRUCE LEHMAN

*Commissioner of Patents and Trademarks*